US009488322B2

(12) United States Patent
Athalye et al.

(10) Patent No.: US 9,488,322 B2
(45) Date of Patent: Nov. 8, 2016

(54) LED LAMP WITH LED BOARD HEAT SINK

(71) Applicant: Cree, Inc., Durham, NC (US)

(72) Inventors: Praneet Athalye, Morrisville, NC (US); Curt Progl, Raleigh, NC (US)

(73) Assignee: Cree, Inc., Durham, NC (US)

( * ) Notice: Subject to any disclaimer, the term of this patent is extended or adjusted under 35 U.S.C. 154(b) by 43 days.

(21) Appl. No.: 14/259,232

(22) Filed: Apr. 23, 2014

(65) Prior Publication Data

US 2015/0308628 A1 Oct. 29, 2015

(51) Int. Cl.

| | |
|---|---|
| ***F21V 29/00*** | (2015.01) |
| ***F21K 99/00*** | (2016.01) |
| *F21V 23/00* | (2015.01) |
| *F21Y 101/02* | (2006.01) |
| *F21Y 103/02* | (2006.01) |
| *F21Y 111/00* | (2016.01) |

(52) U.S. Cl.

CPC ..... *F21K 9/135* (2013.01); *F21K 9/137* (2013.01); *F21V 23/002* (2013.01); *F21Y 2101/02* (2013.01); *F21Y 2103/022* (2013.01); *F21Y 2111/001* (2013.01)

(58) Field of Classification Search

CPC ..... F21V 29/004; F21K 9/135

See application file for complete search history.

(56) References Cited

U.S. PATENT DOCUMENTS

| | | | |
|---|---|---|---|
| 3,581,162 | A | 5/1971 | Wheatley |
| 5,463,280 | A | 10/1995 | Johnson |
| 5,561,346 | A | 10/1996 | Byrne |
| 5,585,783 | A | 12/1996 | Hall |
| 5,655,830 | A | 8/1997 | Ruskouski |
| 5,688,042 | A | 11/1997 | Madadi et al. |
| 5,806,965 | A | 9/1998 | Deese |
| 5,947,588 | A | 9/1999 | Huang |
| 5,949,347 | A | 9/1999 | Wu |
| 6,220,722 | B1 | 4/2001 | Begemann |
| 6,227,679 | B1 | 5/2001 | Zhang et al. |
| 6,234,648 | B1 | 5/2001 | Borner et al. |
| 6,250,774 | B1 | 6/2001 | Begemann et al. |
| 6,276,822 | B1 | 8/2001 | Bedrosian et al. |
| 6,465,961 | B1 | 10/2002 | Cao |
| 6,523,978 | B1 | 2/2003 | Huang |
| 6,550,953 | B1 | 4/2003 | Ichikawa et al. |
| 6,634,770 | B2 | 10/2003 | Cao |
| 6,659,632 | B2 | 12/2003 | Chen |
| 6,709,132 | B2 | 3/2004 | Ishibashi |
| 6,803,607 | B1 | 10/2004 | Chan et al. |
| 6,848,819 | B1 | 2/2005 | Arndt et al. |
| 6,864,513 | B2 | 3/2005 | Lin et al. |
| 6,948,829 | B2 | 9/2005 | Verdes et al. |
| 6,982,518 | B2 | 1/2006 | Chou et al. |
| 7,048,412 | B2 | 5/2006 | Martin et al. |

(Continued)

FOREIGN PATENT DOCUMENTS

| | | | |
|---|---|---|---|
| CN | 103375693 | A | 10/2013 |
| EP | 1058221 | A2 | 12/2000 |

(Continued)

*Primary Examiner* — Andrew Coughlin

(74) *Attorney, Agent, or Firm* — Dennis J. Williamson; Moore & Van Allen PLLC

(57) ABSTRACT

A LED lamp includes an optically transmissive enclosure and a base connected to the enclosure. LEDs are mounted on a substrate for emitting light when energized though an electrical path from the base. The substrate and the LEDs are mounted outside of the enclosure for transmitting light from the plurality of LEDs into the enclosure.

25 Claims, 12 Drawing Sheets

(56) References Cited

U.S. PATENT DOCUMENTS

| | | | |
|---|---|---|---|
| 7,080,924 | B2 | 7/2006 | Tseng et al. |
| 7,086,756 | B2 | 8/2006 | Maxik |
| 7,086,767 | B2 | 8/2006 | Sidwell et al. |
| 7,144,135 | B2 | 12/2006 | Martin et al. |
| 7,165,866 | B2 | 1/2007 | Li |
| 7,172,314 | B2 | 2/2007 | Currie et al. |
| 7,213,940 | B1 | 5/2007 | Van De Ven et al. |
| 7,354,174 | B1 | 4/2008 | Yan |
| 7,396,142 | B2 | 7/2008 | Laizure, Jr. et al. |
| 7,600,882 | B1 | 10/2009 | Morejon et al. |
| 7,726,836 | B2 | 6/2010 | Chen |
| 7,824,065 | B2 | 11/2010 | Maxik |
| 8,004,172 | B2 | 8/2011 | Hussell et al. |
| 8,013,501 | B2 | 9/2011 | Carroll et al. |
| 8,021,025 | B2 | 9/2011 | Lee |
| 8,253,316 | B2 | 8/2012 | Sun et al. |
| 8,272,762 | B2 | 9/2012 | Maxik et al. |
| 8,274,241 | B2 | 9/2012 | Guest et al. |
| 8,277,082 | B2 | 10/2012 | Dassanayake et al. |
| 8,282,250 | B1 | 10/2012 | Dassanayake et al. |
| 8,292,468 | B2 | 10/2012 | Narendran et al. |
| 8,322,896 | B2 | 12/2012 | Falicoff et al. |
| 8,371,722 | B2 | 2/2013 | Carroll |
| 8,400,051 | B2 | 3/2013 | Hakata et al. |
| 8,415,865 | B2 | 4/2013 | Liang et al. |
| 8,421,320 | B2 | 4/2013 | Chuang |
| 8,421,321 | B2 | 4/2013 | Chuang |
| 8,421,322 | B2 | 4/2013 | Carroll et al. |
| 8,421,329 | B2 | 4/2013 | Liang et al. |
| 8,449,154 | B2 | 5/2013 | Uemoto et al. |
| 8,502,468 | B2 | 8/2013 | Li et al. |
| 8,641,237 | B2 | 2/2014 | Chuang |
| 8,653,723 | B2 | 2/2014 | Cao et al. |
| 8,696,168 | B2 | 4/2014 | Li et al. |
| 8,740,415 | B2 | 6/2014 | Wheelock |
| 8,750,671 | B1 | 6/2014 | Kelly et al. |
| 8,752,984 | B2 | 6/2014 | Lenk et al. |
| 8,760,042 | B2 | 6/2014 | Sakai et al. |
| 2004/0201990 | A1 | 10/2004 | Meyer |
| 2009/0184618 | A1 | 7/2009 | Hakata et al. |
| 2009/0302730 | A1* | 12/2009 | Carroll et al. ..... 313/46 |
| 2011/0103055 | A1* | 5/2011 | Carroll ..... 362/235 |
| 2011/0273102 | A1 | 11/2011 | Van De Ven et al. |
| 2012/0040585 | A1 | 2/2012 | Huang |
| 2012/0043878 | A1 | 2/2012 | Liang et al. |
| 2012/0218774 | A1* | 8/2012 | Livingston ..... 362/555 |
| 2012/0243230 | A1 | 9/2012 | Carroll et al. |
| 2013/0026923 | A1 | 1/2013 | Athalye et al. |
| 2013/0026925 | A1 | 1/2013 | Ven et al. |
| 2013/0027904 | A1 | 1/2013 | Fan |
| 2013/0051013 | A1* | 2/2013 | Ariyoshi ..... F21V 29/004 362/235 |
| 2013/0069535 | A1 | 3/2013 | Athalye |
| 2013/0069547 | A1 | 3/2013 | Van De Ven et al. |
| 2013/0127353 | A1 | 5/2013 | Athalye et al. |
| 2013/0162149 | A1 | 6/2013 | Van De Ven et al. |
| 2013/0162153 | A1 | 6/2013 | Van De Ven et al. |
| 2013/0169159 | A1 | 7/2013 | Lys |
| 2013/0229801 | A1 | 9/2013 | Breidenassel et al. |
| 2013/0293135 | A1 | 11/2013 | Hu et al. |
| 2014/0292176 | A1 | 10/2014 | Athalye |

FOREIGN PATENT DOCUMENTS

| | | | |
|---|---|---|---|
| EP | 0890059 | B1 | 6/2004 |
| GB | 2345954 | A | 7/2000 |
| JP | H09265807 | A | 10/1997 |
| JP | 2000173304 | A | 6/2000 |
| JP | 2001118403 | A | 4/2001 |
| JP | 2007059930 | A | 3/2007 |
| JP | 2008288183 | A | 11/2008 |
| JP | 2009117346 | A | 5/2009 |
| JP | 3153766 | U | 9/2009 |
| JP | 2009277586 | A | 11/2009 |
| WO | 0124583 | A1 | 4/2001 |
| WO | 0160119 | A2 | 8/2001 |
| WO | 2012011279 | A1 | 1/2012 |
| WO | 2012031533 | A1 | 3/2012 |
| WO | 2013153116 | A1 | 10/2013 |

* cited by examiner

LED LAMP WITH LED BOARD HEAT SINK

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs, which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. Since, ideally, an LED lamp designed as a replacement for a traditional incandescent or fluorescent light source needs to be self-contained; a power supply may be included in the lamp structure along with the LEDs or LED packages and the optical components. A heatsink is also often needed to cool the LEDs and/or power supply in order to maintain appropriate operating temperature.

SUMMARY OF THE INVENTION

In some embodiments, a LED lamp comprises an enclosure, the enclosure being at least partially optically transmissive and a base connected to the enclosure. An LED assembly comprises a plurality of LEDs for emitting light when energized though an electrical path from the base. The LED assembly and the plurality of LEDs are mounted outside of the enclosure for transmitting light through the enclosure into the interior of the enclosure.

The base may comprise an Edison base. The plurality of LEDs may be disposed near the surface of the enclosure and may be positioned to direct light primarily toward the enclosure. The plurality of LEDs may be disposed about the periphery of the enclosure. The LED assembly may comprise a LED board, the plurality of LEDs may be mounted to the LED board. The LED board may comprise a thermally conductive material. The outer dimensions of the lamp may fall within the ANSI standards for an A19 bulb. The electrical path may comprise an electrical conductor formed on the LED board. The LED board may comprise one of a MCPCB, flex circuit and a lead frame. The LED assembly may be formed into a three-dimensional shape that comprises portions that are shaped to conform to the shape of the enclosure. The LED board may be bent to form the three-dimensional shape. A plurality of LED boards may be provided where each of the plurality of LED boards supports at least one LED. The plurality of LED boards may be connected to one another by a support. The plurality of LEDs may be disposed in an optically transmissive channel in the enclosure. The channel may define a recess that substantially surrounds the light emitting portion of the plurality of LEDs. The channel may be disposed in front of and to the sides of the plurality of LEDs. The LED assembly may be dimensioned to enclose the channel such that light is reflected by the LED assembly into the enclosure. The LED assembly may be ring shaped. A metal band may cover the LED assembly and may be thermally coupled to the LEDs. The LED assembly may be located at the approximate center of the enclosure. The plurality of the LEDs may face at various angles relative to the longitudinal axis of the lamp. The LED assembly may be exposed to the ambient environment such that heat is dissipated from the plurality of LEDs via the LED assembly. The lamp may be a directional lamp comprising a reflective surface and a lens defines an exit surface of the lamp. The base may contain at least a portion of the lamp electronics. An electrical conductor is in the electrical path extends between the LED assembly and the base. The electrical conductor may extend outside of the enclosure between the LED assembly and the base. The electrical conductor may extend in a channel formed in the outside of the enclosure. The electrical conductor may extend inside of the enclosure between the LED assembly and the base. The electrical conductor may extend through a hole in the enclosure. The electrical conductor may comprise a part of the LED assembly.

DETAILED DESCRIPTION

Figure 1:
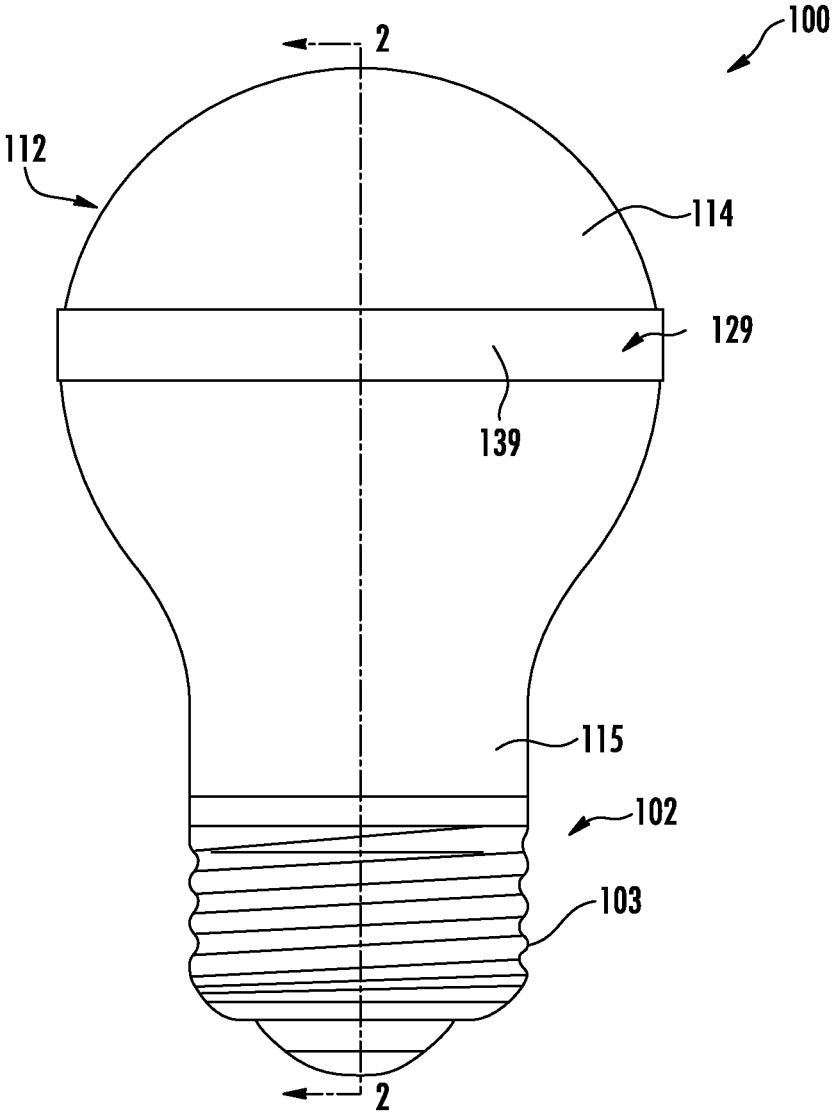
FIG. 1 is a plan view of an embodiment of a lamp of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Figure 2:
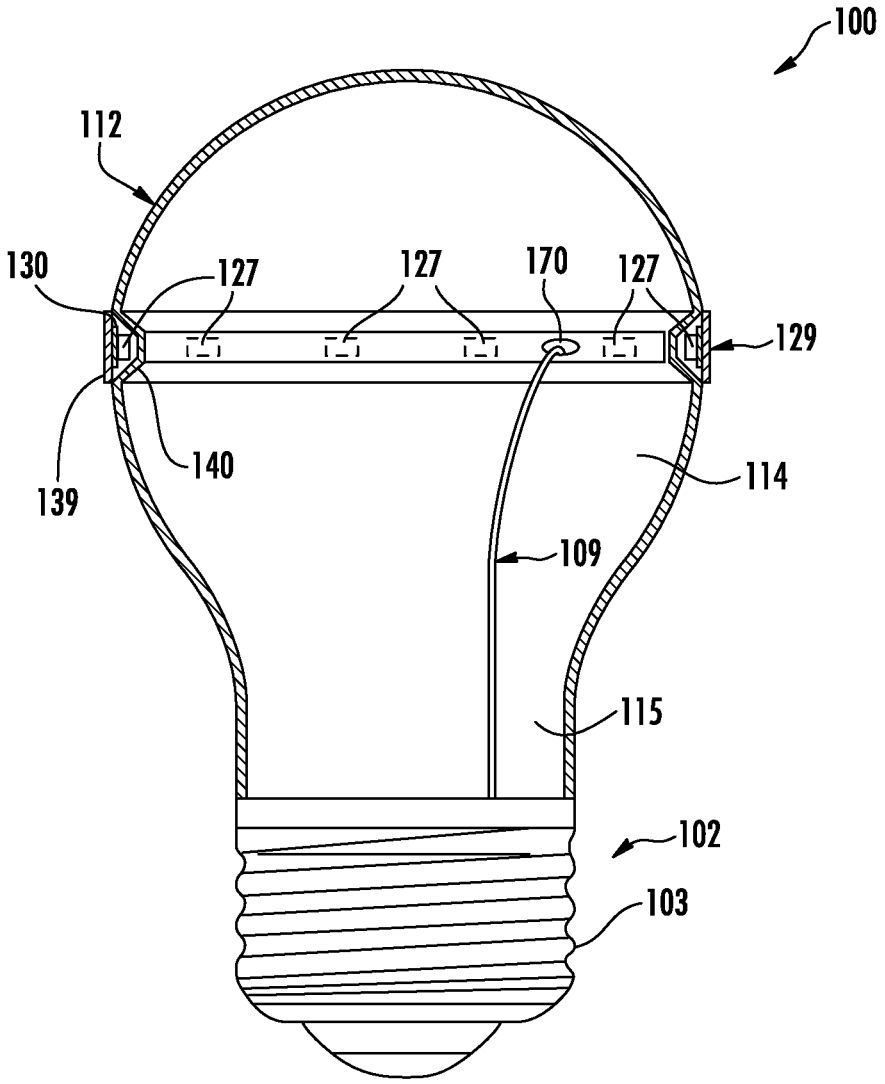
FIG. 2 is a section view of the lamp of FIG. 1 taken along line 2-2 of FIG. 1.

FIGS. 1 and 2 show a lamp 100 according to some embodiments of the present invention. Lamp 100 comprises a base 102 connected to an optically transmissive enclosure 112. Lamp 100 may be used as an A-series lamp with an Edison base 102; more particularly, lamp 100 may be designed to serve as a solid-state replacement for an A19, or other A-series, incandescent bulb. The Edison base 102 as shown and described herein may be implemented through the use of an Edison screw connector 103. An LED assembly 129 comprises at least one, and typically a plurality of, LEDs 127 mounted on a LED board and are operable to emit light when energized through an electrical connection through the Edison base 102. The LEDS board supports the individual LEDs, LED chips or LED packages 127 (hereinafter "LEDs"). In some embodiments, electrical circuitry may be provided on the LED board that forms part of the electrical path to the LEDs 127 and that delivers electric current to the LEDs 127. While a lamp having the size and form factor of a standard-sized household incandescent bulb is shown, the lamp may have other the sizes and form factors.

Enclosure 112 is, in some embodiments, made of glass, quartz, borosilicate, silicate, polycarbonate, other plastic or other suitable material. The enclosure 112 may be of similar shape to that commonly used in household incandescent bulbs. The enclosure 112 may have a traditional bulb shape having a globe shaped main body 114 that tapers to a narrower neck 115. In one embodiment the enclosure 112 may be made of glass or a plastic such as polycarbonate or acrylic. The enclosure 112 may be transparent or translucent such that light may be emitted into the interior of the enclosure, pass through the enclosure and may be emitted from the enclosure. The enclosure 112 may be formed of a light diffusing material or a light diffusing material may be added to a transparent enclosure. The enclosure 112 may be at least partially optically transmissive and may be entirely optically transmissive such that light may be emitted from the lamp through the enclosure. In some embodiments, the enclosure 112 is coated on the inside with silica, providing a diffuse scattering layer that produces a more uniform far field pattern. The enclosure may also be etched, frosted or coated. The diffuser may also be provided by the optical characteristics of the material of the enclosure itself such as where the enclosure is made of polycarbonate. Alternatively, the surface treatment may be omitted and a clear enclosure may be provided. The enclosure 112 may also be provided with a shatter proof or shatter resistant coating and/or an anti-reflective coating. It should also be noted that in this or any of the embodiments shown here, the optically transmissive enclosure 112 or a portion of the optically transmissive 112 enclosure could be coated or impregnated with phosphor.

Figure 4:
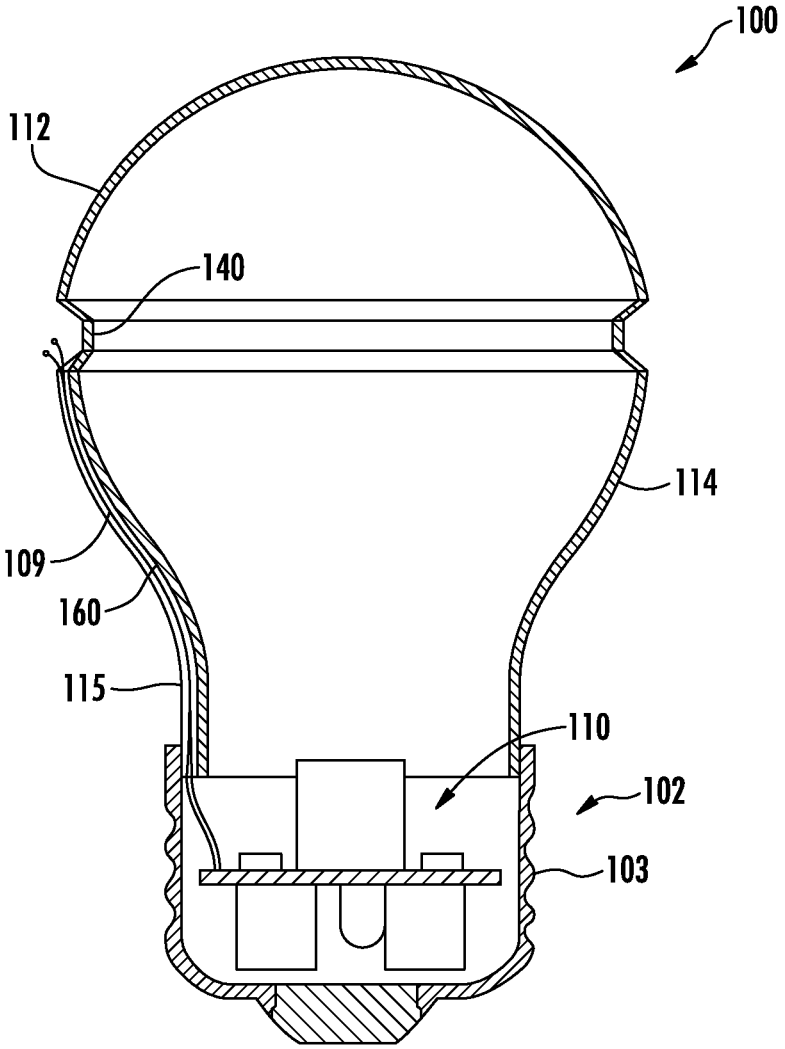
FIG. 4 is a section view of another embodiment of the lamp of the invention 1.
Figure 6:
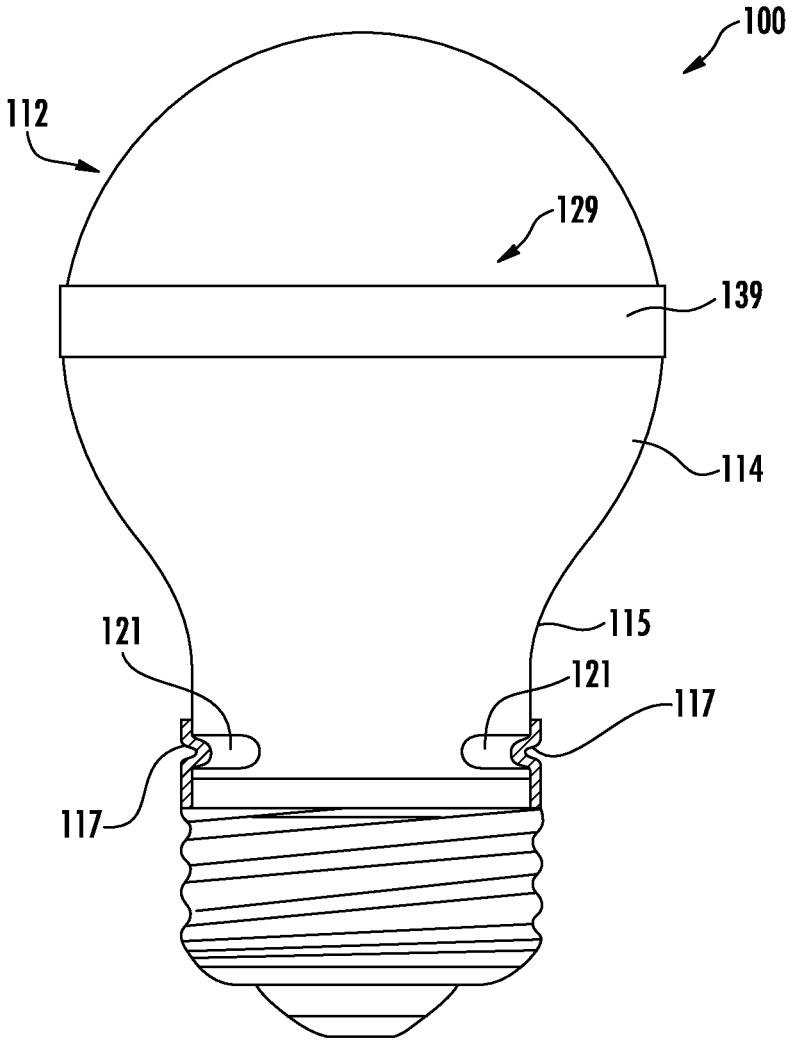
FIG. 6 is a partial section view of an alternate embodiment of a lamp of the invention.

A lamp base 102 such as an Edison base functions as the electrical connector to connect the lamp 100 to an electrical socket or other connector. Depending on the embodiment, other base configurations are possible to make the electrical connection such as other standard bases or non-standard bases. Base 102 may include the electronics 110 for powering lamp (as shown in FIG. 4) and may include a power supply and/or driver and form all or a portion of the electrical path between the mains and the LEDs 127. Base 102 may also include only part of the power supply circuitry while some components may reside on the LED assembly 129 or elsewhere in the enclosure 112. Electrical conductors 109 run between the LEDs 127 and the electronics in the lamp base 102 to carry both sides of the supply to provide critical current to the LEDs 127. The base 102 comprises an electrically conductive Edison screw 103 for connecting to an Edison socket. The Edison screw 103 may be connected to the enclosure by adhesive, mechanical connector, welding, separate fasteners or the like. In one embodiment the area of the enclosure near the opening in neck 115 may be formed with a notch or a plurality of notches 121 such that the Edison screw 103 may be crimped 117 to engage the notches 121 and secure the Edison screw 103 to the enclosure 112 as shown in FIG. 6. In addition to, or in place of, this mechanical connection the base 102 may also be secured to the enclosure 112 using adhesive. The Edison screw 103 defines an internal cavity for receiving the electronics 110 of the lamp including the power supply and/or drivers or a portion of the electronics for the lamp. The base 102 may be potted to physically and electrically isolate and protect the lamp electronics 110. While an Edison base is shown the base may comprise any suitable connector for providing current to the lamp including a bayonet type connector or other connector.

Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. The boost supply is connected to high voltage LEDs operating at greater than 200V. Examples of boost topologies are described in U.S. patent application Ser. No. 13/462,388, entitled "Driver Circuits for Dimmable Solid State Lighting Apparatus", filed on May 2, 2012 which is incorporated by reference herein in its entirety; and U.S. patent application Ser. No. 13/662,618, entitled "Driving Circuits for Solid-State Lighting Apparatus with High Voltage LED Components and Related Methods", filed on Oct. 29, 2012 which is incorporated by reference herein in its entirety. Other embodiments are possible using different driver configurations or a boost supply at lower voltages.

The lamp 100 comprises a solid-state lamp comprising a plurality of LEDs 127. Multiple LEDs 127 can be used together. The LEDs 127 are mounted on an LED board where the LED board typically supports a plurality of LEDs 127. The LED board comprises an efficient thermal conducting material. In some embodiments the LED board may comprise a lead frame structure, printed circuit board (PCB), flexible PCB, metal core printed circuit board (MCPCB), flex circuit or any suitable thermally conductive substrate for mounting the LEDs. In addition to being thermally conductive and providing physical support for the LEDs 127, the LED board may also provide at least part of the electrical path between the electronics 110 in the base and the LEDs 127. In some embodiments, conductive traces or wire traces may be formed as part of the LED board that form part of the electrical path between the lamp electronics 110 in the base 102 and the LEDs 127. In other embodiments, separate electric conductors may be provided to form the electrical path between the lamp electronics and the LEDs.

Figure 7:
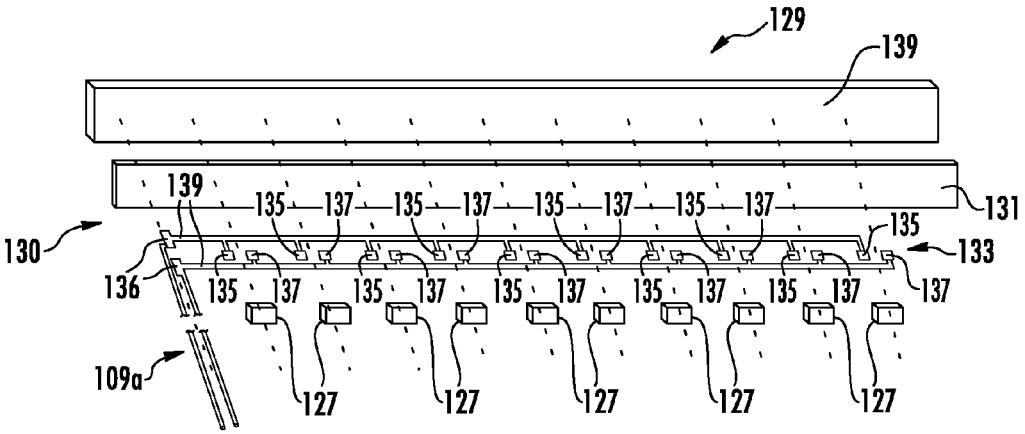
FIGS. 7 through 9 are views showing alternate embodiments of the LED assembly usable in the lamp of the invention.

Referring to FIG. 7 in some embodiments the LED assembly 129 may comprise an LED board comprising a flex circuit 130 comprising a flexible layer of a dielectric material 131 such as a plastic, polymeric, polyimide, polyester or other material to which a conductive layer 133 of copper or other electrically and thermally conductive material is applied such as by adhesive. Electrical traces are formed in the conductive layer 133 of the electrically conductive material to form electrical pads 135 and 137 for attaching to the anode side and cathode side contacts of the electrical components such as LEDs 127 (and other lamp electronics). The flex circuit 130 forms part of the electrical path between the LEDs and the electrical components 110 in the base 102. The flex circuit 130 may be mounted on or attached to a metal band 139 where the band 139 at least partially surrounds the dielectric layer 131 and is thermally coupled to the LEDs 127 for dissipating heat to the ambient environment.

Figure 8:
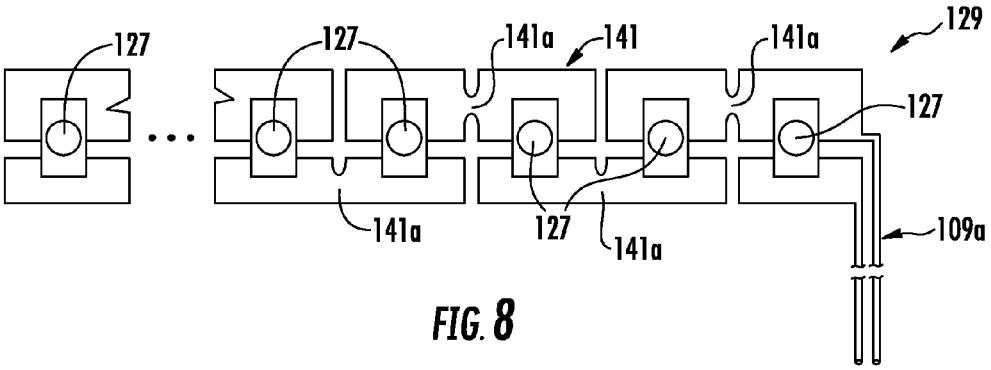

Referring to FIG. 8, in other embodiments, the LED assembly 129 may comprise a lead frame 141 that supports the LEDs 127 and provides the electrical path to the LEDs 127 and may be made of an electrically conductive material such as copper, copper alloy, aluminum, steel, gold, silver, alloys of such metals, thermally conductive plastic or the like. The lead frame 141 provides the electrical circuit for delivering current to the LEDs 127 and provides mounting pads for attaching to the anode side and cathode side contacts of the LEDs. Where a lead frame or other similar conductive layer is used, an isolator circuit may be used to make a Class 2 power supply. The lead frame 141 may also be connected to a dielectric layer 131 that is attached or mounted to a metal board 139.

Figure 9:
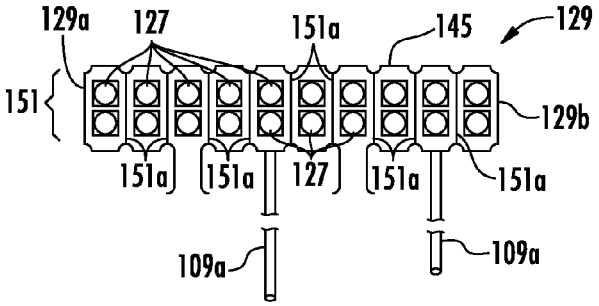

Referring to FIG. 9 in other embodiments the LED board may comprise a MCPCB 145 that comprises a thermally and electrically conductive core made of aluminum or other similar pliable metal material. The core is covered by a dielectric material such as polyimide. Traces are formed in the metal core to provide the electrical circuit for delivering current to the LEDs 127 and to provide mounting pads for attaching to the anode side and cathode side contacts of the LEDs 127.

In one method, the LED board such as the flex circuit, lead frame, or MCPCB is formed as a flat member and the LEDs 127 are mounted on the LED board in the flat condition. The LED board may then bent into a suitable shape. Because the LED board is made of thin bendable material and the anodes and cathodes may be positioned in a wide variety of locations, and the number of LEDs may vary, the LED board may be configured such that it may be bent into a wide variety of shapes and configurations. In the case of the MCPCB or other similar LED boards the LEDs 127 may be located on flat sections of the MCPCB and the MCPCB may be bent along the score lines 151*a* to form the flat sections on which the LEDs 127 are mounted into a three-dimensional shape where the shape is selected to project a desired light pattern from the lamp 100. In a lead frame LED board 141 the lead frame may be bent at narrowed areas 141*a*. In other embodiments the LED board, such as the flex circuit 133, may be bent more gradually over all or a large portion of the substrate such that the bend of the substrate is more gradual without sharp bend lines. In any of the embodiments described herein the LED board may be bent at score lines or it may be bent over its entire surface provided that the bending of the substrate does not adversely affect the mechanical, thermal and electrical connection between the LEDs and the substrate.

The LED assembly 129 is formed into a three-dimensional shape that comprises portions that are shaped to conform to the shape of the enclosure 112 such that when the LED assembly 129 is mounted on the enclosure 112 the LED assembly 129 follows the form of the enclosure 112 and is exposed to the ambient environment and fits the form factor of the lamp. The LEDs 127 are disposed on the outside of the enclosure 112 adjacent to the exterior surface of the enclosure 112 and face generally toward the interior of the enclosure. A three-dimensional shape means that the LED assembly comprises mounting surfaces for the LEDs 127 that are in more than one plane such that the LEDs are directed in more than one direction relative to the axis of the lamp. In some embodiments, combinations of such structures may be used.

The LED boards provide the physical support for the LEDs 127 and properly position the LEDs adjacent the enclosure 112. In some embodiments low voltage LEDs may be used. In some embodiments the LEDs may comprise approximately 80 DA LED chips sold by CREE INC. with PD5 and droplet lenses. The 80 DA chips may be packaged in XGB components sold by CREE INC. In one embodiment the LEDs may comprise 5 XGB LEDs each having 15 DA LED chips and in another embodiment the LEDs may comprise 10 XGB LEDs each having 8 DA LED chips. In other embodiments different LEDs may be used and a greater or fewer number of LEDs may be used.

In one embodiment the LED assembly 129 is arranged such that the LEDs 127 are disposed about the periphery of the enclosure 112 at or near the surface of the enclosure and are positioned to direct light primarily inwardly toward the center of the enclosure. The LED assembly 129 may be in electrical connection with the electronics 110 in the base 102 such that an electrical connection is established between the base 102 and the LEDs 127 mounted on the LED assembly 129. The LED assembly 129 may comprise a single one-piece component or the LED assembly may comprise a plurality of separate components. The LED assembly 129 may be considered a mount for the LEDs 127. The LED assembly 129 and LEDs 127 may be evenly spaced about the periphery of the enclosure 112 such that the light projected from the LEDs 127 projects over an equal area of the enclosure 112 and creates a uniform far field pattern.

Figure 3:
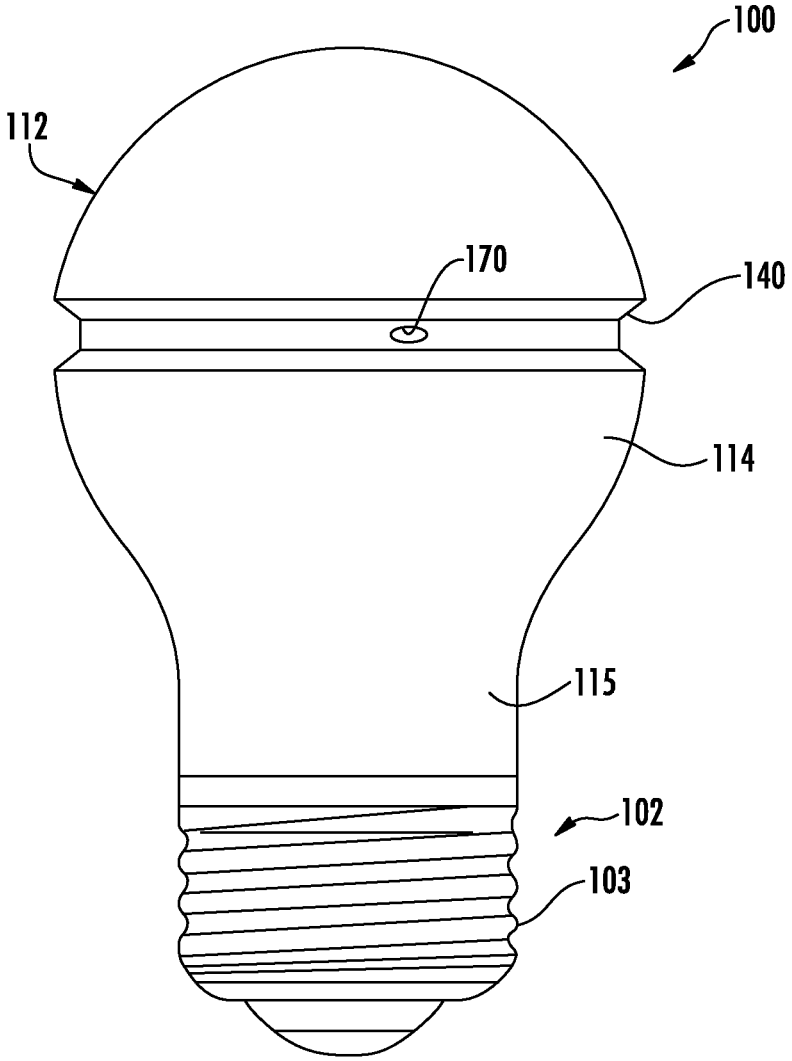
FIG. 3 is a plan view of the enclosure and base of the lamp of FIG. 1.

For example, in the embodiment illustrated in FIGS. 1-3 the LED assembly 129 is formed as a ring or band that extends about the exterior periphery of the enclosure 112. The LEDs 127 are disposed between the LED board and the enclosure 112 on the exterior of the enclosure 112 to project light through the enclosure and into the interior of the enclosure. The light is then transmitted from the interior of the enclosure 112 through the enclosure 112 and is emitted from the lamp.

In one embodiment the enclosure 112 comprises a channel or recess 140 formed about the periphery of the exterior of the enclosure 112 where the LEDs 127 are positioned in the channel 140 and the LED board and or the metal band 139 are disposed behind the LEDs 127. In one embodiment the channel 140 extends about the "equator" of the enclosure 112 where it is positioned approximately at the center of the globe shaped main body 114 along the longitudinal axis of the lamp. The channel 140 creates a recess that substantially surrounds the light emitting portion of the LEDs 127 such that the optically transparent material of the enclosure 112 is disposed in front of and to the sides of the LEDs 127 such that light emitted from the LEDs, both forward of the LEDs and laterally of the LEDs, is directed into the enclosure 112 through the walls of the channel 140. The LED assembly 129 may be dimensioned to enclose the channel 140 such that light that does not enter the enclosure 112 directly from the LEDs may be reflected by the LED assembly 129 into the enclosure 112. The channel 140 should be deep enough that most of the light emitted from the LEDs is directed into the enclosure but shallow enough that the lamp conforms to Energy Star requirements for an omnidirectional lamp. The depth of the channel may be determined in part by the type of LEDs used and the light pattern emitted by the LEDs.

The LED assembly 129 may be mounted to the enclosure 112 in a variety of manners. The LED assembly 129 may be attached to the enclosure 112 by adhesive, welding, a mechanical connection, other methods or a combination of such methods. In one embodiment of a mechanical connection, connectors may also be molded into, or otherwise formed on, the enclosure 112 which are engaged by mating connectors on the LED assembly 129. For example, the enclosure 112 may comprise female receptacles or male engagement members that receive mating male engagement members or female receptacles formed on the LED assembly 129. The LED assembly 129 is mounted on the enclosure such that the LED assembly is exposed to the ambient environment where it dissipates heat from the lamp.

Figure 10:
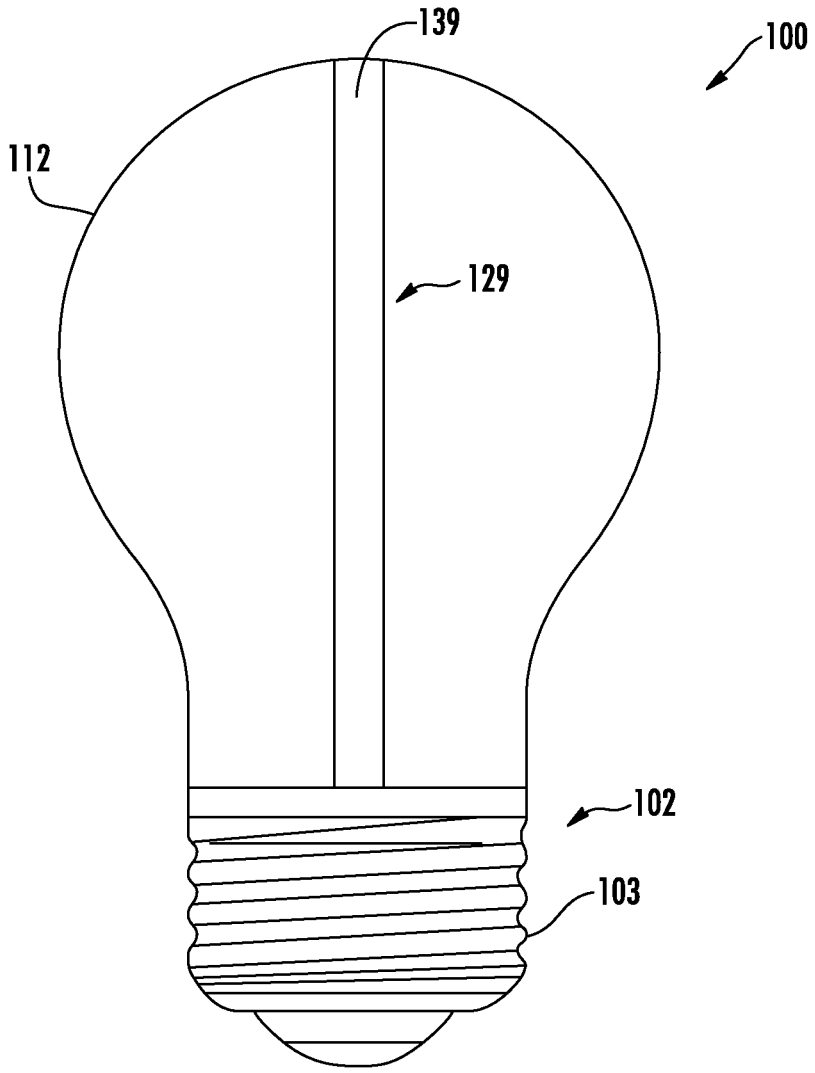
FIGS. 10 and 11 are plan views showing alternate embodiments of the lamp of the invention.

Referring to FIG. 10 in other embodiments the channel 140 may be formed to extend generally parallel to the longitudinal axis of the lamp where the channel extends from near the base 102, over the distal end of the enclosure 112 and to adjacent the base on the opposite side of the enclosure. The LED assembly 129 may be positioned in the channel 140. In other embodiments more than one channel may be used where the channels extend about different portions of the enclosure 112.

Figure 11:
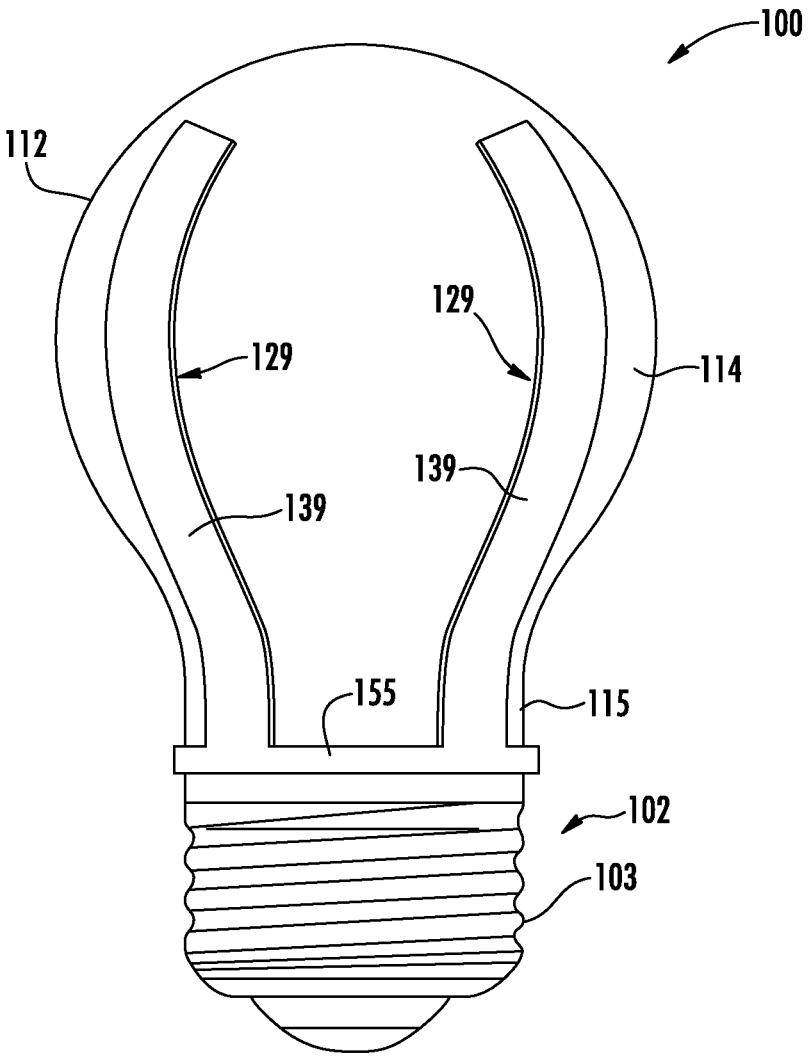
Figure 12:
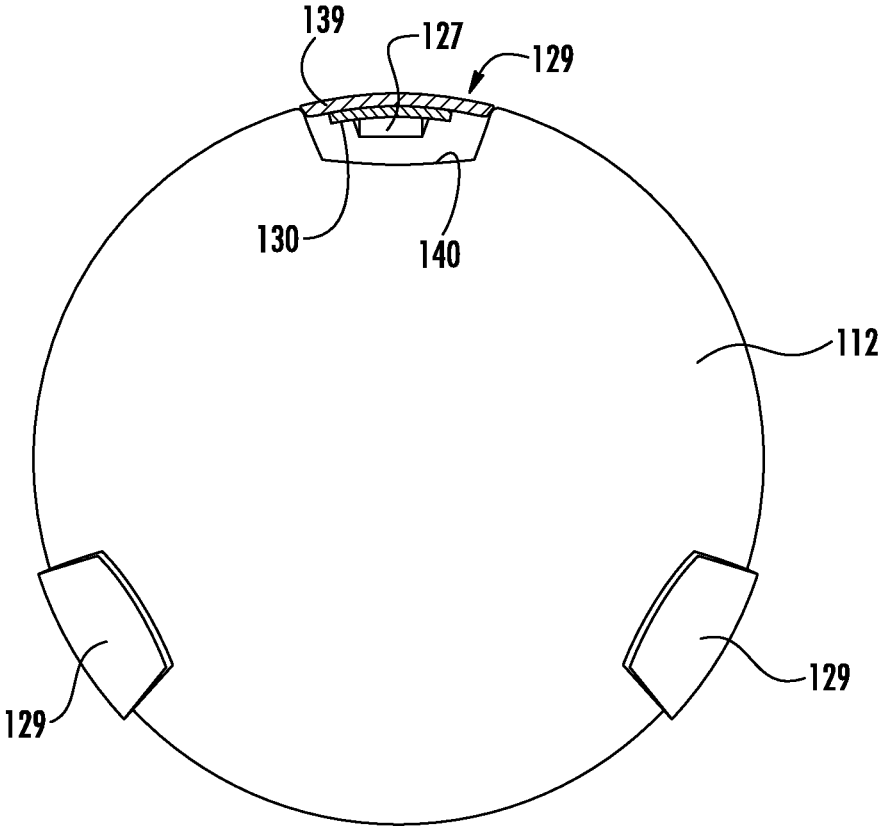
FIG. 12 is a top view of the lamp of FIG. 11.
Figure 14:
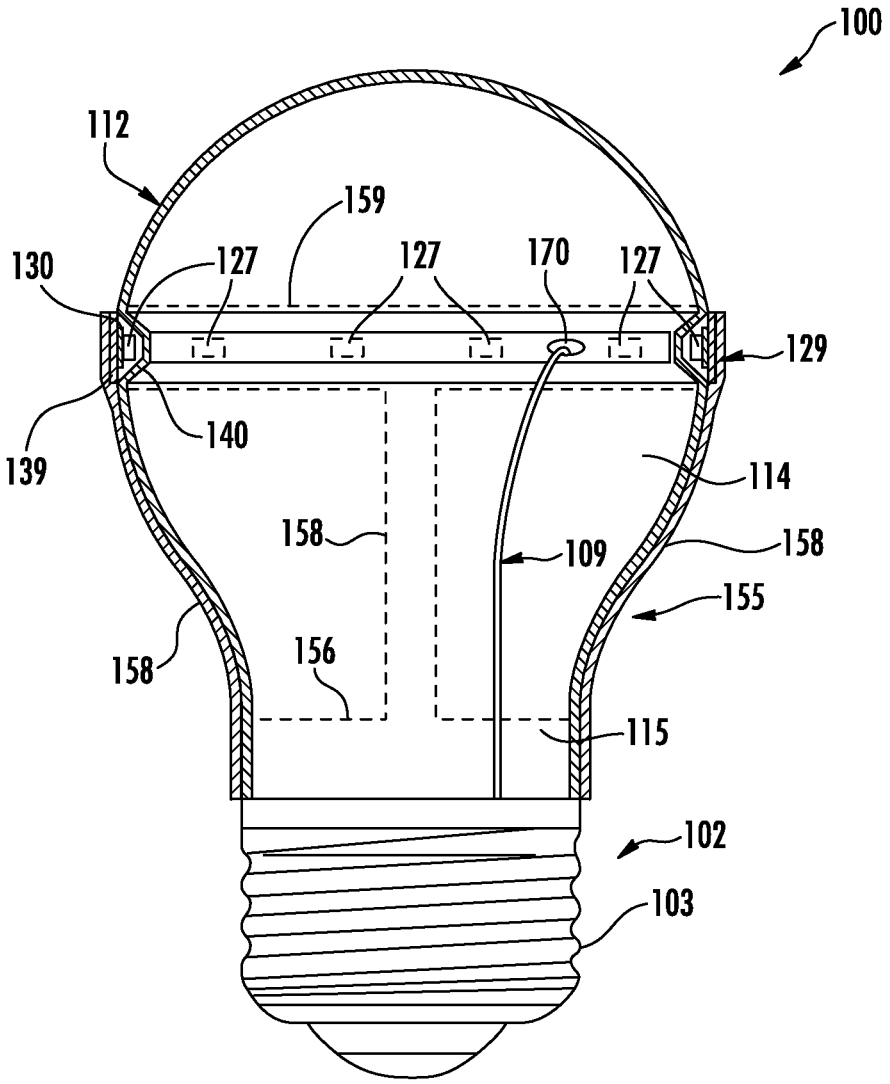
FIG. 14 is a partial section view of an alternate embodiment of the lamp of the invention.

In another embodiment the enclosure 112 may comprise a plurality of channels for receiving the LEDs and a plurality of LED assemblies 129 that are located in the channels 140 and that extend along the surface of the enclosure. In one embodiment three LED assemblies 129 are used (as shown in FIGS. 11 and 12) where each LED assembly 129 is disposed approximately 120 degrees from the adjacent LED assembly such that light emitted from each LED assembly covers about 120 degrees of the enclosure 112. While in some embodiments the LED assemblies are evenly spaced about the periphery of the enclosure the LED assemblies need not be evenly spaced. The LED assemblies are arranged such that the light emitted from each of the LED assemblies overlaps with the light emitted from the other LED assemblies. As a result, while each LED assembly is arranged to project light over a portion of the enclosure the light from the LED assemblies overlaps to a large degree. While a lamp with three LED assemblies 129 is shown, a greater or fewer number of LED assemblies and associated LEDs may be used. The LED assemblies may be arranged in a variety of patterns relative to the enclosure 112. The LED assemblies 129 may be connected to one another by a connective support 155 that physically supports the LED assemblies 129. The LED assemblies 129 and support 155 may be formed of a single piece of material or they may be formed of separate components connected to one another. Referring to FIG. 14 the support 155 may comprise a base 156 attached adjacent the base 102 having a plurality of arms 158 extending therefrom that support a ring 159. The LED assembly 129 may be attached to the ring 159 rather than to the enclosure 112.

The support 155 may be dimensioned such that it fits the form factor of the lamp in the area adjacent to the base 102, neck portion 115 of the enclosure 112 or the area between the base 102 and the enclosure 112. The support 155 and/or base 156 may be positioned between the base 102 and the enclosure 112, it may be fit into or over the base 102 or it may be fit into or over the enclosure 112. In some embodiments the base 102 may be connected directly to the enclosure 112 with the support 155 positioned outside of the enclosure 112 and/or base 102 and in other embodiments the support 155 may form the connection between the base 102 and the enclosure 112. For example, as shown in FIG. 11 the support 155 is positioned outside of the enclosure 112 and is exposed to the ambient environment such that the support 155 forms part of the heat dissipating portion of the LED assembly 129. The support 155 may be connected to the base 102 and/or enclosure 112.

The LED assembly 129 is arranged such that a sufficient portion of the LED assembly 129 is exposed to the ambient environment such that heat is dissipated from the LEDs primarily through the LED assembly. In some embodiments at least the back or outside surface of the LED assembly 129 is completely exposed to the exterior of the lamp.

The LED assembly 129 may be bent or otherwise formed to follow the curvature of the enclosure 112 such that the LED assembly 129 is located in channels 140. The LED assembly 129 may be formed with a lateral curvature, i.e. across the short dimension of the substrates, to form a substantially contiguous surface with the enclosure as shown, for example, in FIG. 6.

Because the LED assembly 129 follows the curvature of the enclosure, the LEDs 127 may be located on the substrate such that the LEDs face at various angles relative to the longitudinal axis of the lamp. As a result, light may be directed by various ones of the LEDs 127 toward the top, bottom or sides of the lamp to achieve a desired light pattern. While in the illustrated embodiment, the LEDs 127 are located on each of the LED assemblies 129 in a similar location, the LEDs 127 may be located in different locations on the LED assemblies such that the some of the LEDs may be disposed at more or less of an angle relative to the axis of the bulb than other ones of the LEDs to facilitate the generation of any suitable light pattern. Moreover, selected ones of the LED assemblies 129 may support a greater or fewer number of LEDs 127 than other ones of the LED assemblies.

In some embodiments, the LED assemblies 129 can comprise a reflective coating, surface, layer and/or element on the mounting surface for the LEDs 127 that faces the interior of the enclosure 112. Such an arrangement is distinguished from devices where the LEDs are mounted to a substrate where the LEDs and the substrate is located entirely in the enclosure and the substrate is mounted on or otherwise thermally coupled to a separate heat sink. In the present invention the LEDs and the mounting substrate for the LEDs are on the exterior of the enclosure. The element that forms the mounting surface for the LEDs and the heat dissipating structure are the same physical element and may comprise a LED board and/or other similar component as previously described.

In one embodiment, the enclosure 112 and base 102 are dimensioned to be a replacement for an ANSI standard A19 bulb such that the dimensions of the lamp 100 fall within the ANSI standards for an A19 bulb. The dimensions may be different for other ANSI standards including, but not limited to, A21 and A23 standards. In some embodiments, the LED lamp 100 may be equivalent to standard watt incandescent light bulbs. However, the form factor of the lamp and the light output may be different than standard bulb configurations.

With respect to the features described above with various example embodiments of a lamp, the features can be combined in various ways. The LEDs 127 may comprise an LED die disposed in an encapsulant such as silicone, and LEDs which may be encapsulated with a phosphor to provide local wavelength conversion, as will be described later when various options for creating white light are discussed. A wide variety of LEDs and combinations of LEDs may be used in as described herein. The LEDs 127 are operable to emit light when energized through an electrical path. The LEDs 127 may comprise an LED die disposed in an encapsulant such as silicone, and LEDs which are encapsulated with a phosphor to provide local wavelength conversion, as will be described later when various options for creating white light are discussed. For example, the various methods of including phosphor in the lamp can be combined and any of those methods can be combined with the use of various types of LED arrangements such as bare die vs. encapsulated or packaged LED devices. The embodiments shown herein are examples only, shown and described to be illustrative of various design options for a lamp with an LED array.

LEDs and/or LED packages used with an embodiment of the invention and can include light emitting diode chips that emit hues of light that, when mixed, are perceived in combination as white light. Phosphors can be used as described to add yet other colors of light by wavelength conversion. For example, blue or violet LEDs can be used with the appropriate phosphor. LED devices can be used with phosphorized coatings packaged locally with the LEDs or with a phosphor coating the LED die as previously described. For example, blue-shifted yellow (BSY) LED devices, which typically include a local phosphor, can be used with a red phosphor to create substantially white light, or combined with red emitting LED devices in the array to create substantially white light. A lighting system using the combination of BSY and red LED devices referred to above to make substantially white light can be referred to as a BSY plus red or "BSY+R" system. In such a system, the LED devices used include LEDs operable to emit light of two different colors. A further detailed example of using groups of LEDs emitting light of different wavelengths to produce substantially while light can be found in issued U.S. Pat. No. 7,213,940, which is incorporated herein by reference.

A wide variety of shapes and sizes of the LED assembly 129 and LEDs 127 may be used. The number LED assemblies, the placement of the LED assemblies 129 on the enclosure 112 and the number and locations of the LEDs 127 are selected to develop a desired light pattern for a desired lamp configuration and may vary from that shown in the figures. The number of LEDs may be increased or decreased from that shown in the figures to change the luminosity and/or color output of the lamp, for power or heat considerations or for other reasons. Further, the arrangement of the substrate and the corresponding arrangement of the LEDs 127 on the enclosure may be varied to create different light patterns for different types of lamps. For example, the LEDs may be positioned to create an omnidirectional lamp such as an A19 equivalent lamp, a BR-style or PAR-style directional lamp or other styles of lamps. Numerous configurations of both standard and nonstandard lamps may be provided.

Figure 5:
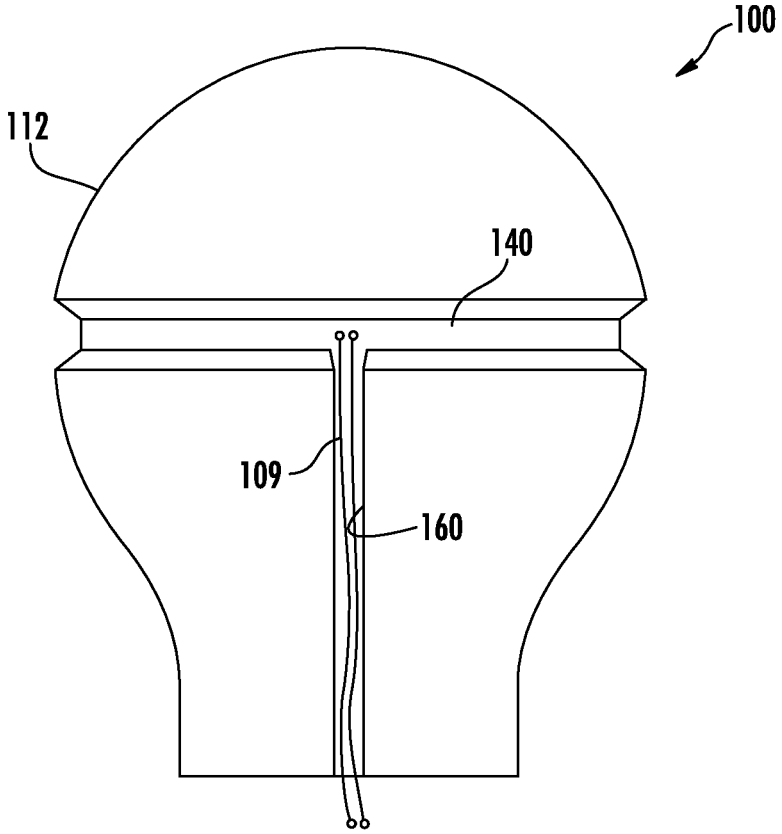
FIG. 5 is a plan view of an embodiment of the enclosure of FIG. 4.

Wire traces or conductors 130 may be formed on the LED assembly for providing current to the LEDs 127 such that the LED assembly 129 forms part of the electrical path between the lamp electronics and the LEDs 127. The wire traces 130 may terminate in contact pads 136 for electrically connecting the substrate to separate electrical conductors 109 from the base 102. The conductors 109 may be electrically connected to the contact pads 136 such as by a soldered connection. In one embodiment the electrical conductors 109 may comprise wires. In another embodiment the electrical conductors may be a conductive portion 109*a* of the LED board such as a trace formed on the flex circuit or a portion of the lead frame or MCPCB as shown in FIGS. 7, 8 and 9. In such an embodiment the conductors need only be separately connected to the lamp electronics 110 in the base 102. To accommodate the electrical path from the LED assembly 129 to the lamp electronics 110 in the base 102, a channel 160 may be formed in the outside of the enclosure 112 that receives electrical conductors 109, 109*a* as shown in FIGS. 4 and 5. The channel 160 extends between the LED assembly 129 and the base 102 such that the electrical conductors 109, 109*a* may be located in the channel 160. In an alternate embodiment the channel 160 may be eliminated and the conductors 109, 109*a* may extend on the surface of the enclosure 112. The conductors 109, 109*a* may be adhered or otherwise secured to the enclosure 112.

In some embodiments the conductors 109, 109*a* may extend through the interior of the enclosure 112 rather than to the exterior of the enclosure such that the conductors are not on the exterior of the lamp. Referring to FIGS. 2 and 3, a hole 170 may be formed in the enclosure 112 adjacent the LED assembly 129 such that the electrical conductors 109, 109*a* may be connected to the lamp electronics 110 and extend through the interior of the enclosure 112 and through the hole 170 where the conductors 109, 109*a* are connected to the electrical conductors of the LED assembly 129 to complete the electrical path to the LEDs 127. In one embodiment the hole 170 may be located in channel 140 such that the conductors 109, 109*a* and the connection between the conductors and the LED assembly 129 are covered by the LED assembly. The hole 170 may be formed by heating the glass enclosure in the area of the hole 170 and blowing a jet of air into the heated area to create the hole.

Figure 13:
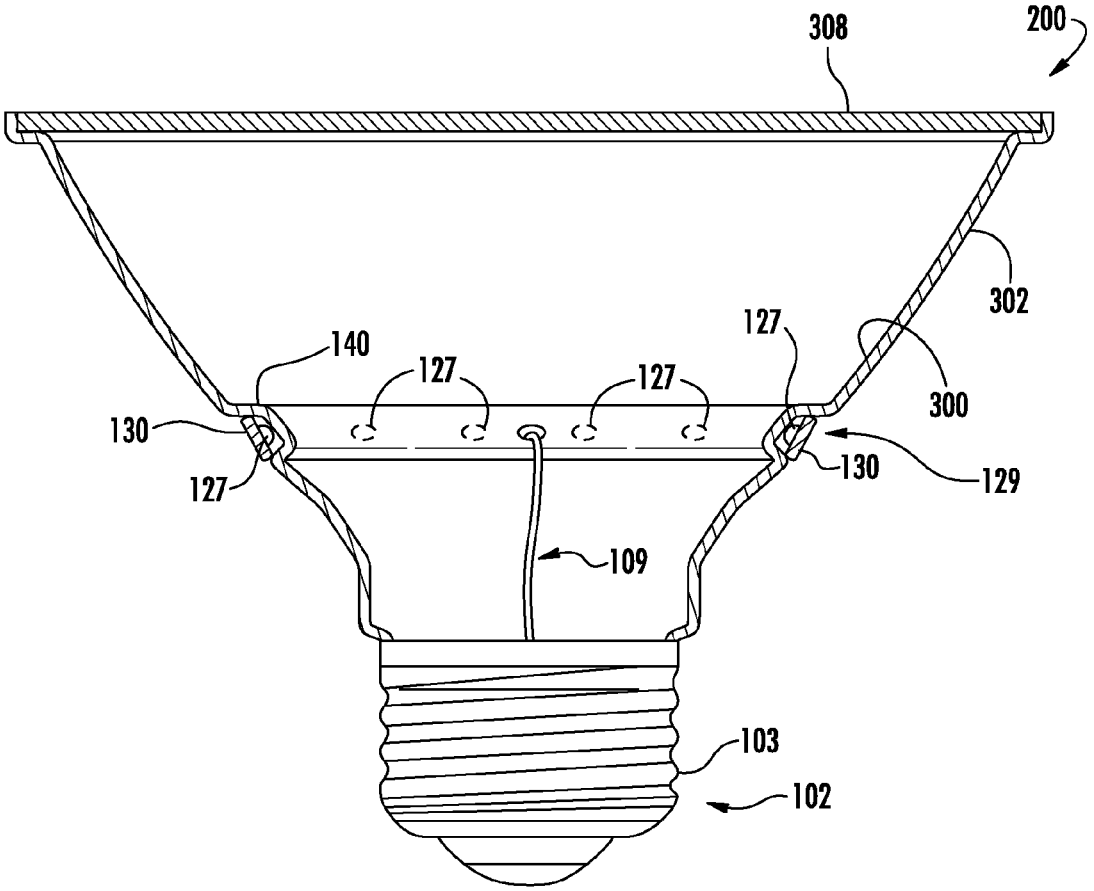
FIG. 13 is a partial section view of another embodiment of the lamp of the invention.

Another embodiment of the lamp and substrate is shown in FIG. 13. FIG. 13 shows a directional lamp 200 that may be used as a replacement for an incandescent bulb such as BR bulb, such as a BR30 or similar bulb, a PAR bulb or other similar bulb. The lamp of the invention includes a base 102 that may comprise an Edison connector 103 as previously described. The enclosure 302 may be connected to base 102. Enclosure 302 may comprise a reflective interior surface 300 that reflects light in a desired pattern. The reflective surface 300 may be a parabolic reflector such as found in a PAR style bulb for reflecting the light in a relatively tight pattern or the reflective surface 162 may have other shapes such as conical, faceted or the like for reflecting the light in a wider pattern such as may be found in a BR style bulb. Further, the reflective surface 300 may be formed on the enclosure 302 or it may be formed as a separate component inside of the enclosure. The reflective surface 300 may be an opaque plastic component made of reflective white material or it may be a specular surface. The reflective surface 300 may also be formed on the inside of a transparent plastic or glass enclosure and may be for example be made of a reflective aluminum layer. Other constructions of the reflective surface and enclosure are possible.

A LED assembly 129 is located on the enclosure 160 as previously described such that the LED assembly 129 is formed into a ring where the ring circumscribes the enclosure 302. The LED assembly may include LEDs 127 operable to emit light through the enclosure 302. The enclosure 302 is formed with a channel 140 for receiving the LED assembly 129 and LEDs 127 as previously described. The channel 140 is formed as an optically transmissive surface such that light may be transmitted through the enclosure 302. The channel 140 may be formed as a clear or diffusive surface. Moreover, the LED assembly 129 may have any suitable shape including shapes as previously described herein. The LED assembly 129 may conform to the shape of the enclosure 302 such that the LED assembly follows the form of the enclosure 302. The exit surface 308 of the lamp may comprise a lens made of for example, diffused glass or polycarbonate. The LED assembly 129 may be connected to the enclosure 302 and lens 308 using a mechanical connection, adhesive, welding, other connection mechanism or a combination of such mechanisms. An electrical conductor 109, 109*a* may electrically connect the LED assembly 129 to the electronics 110 in the base 102 as previously explained.

The surface area of the LED assembly 129 and the metal layer of the LED board is selected such that the LED assembly is able to conduct sufficient heat away from the LEDs 127 and disperse the heat to the ambient environment such that the performance of the LEDs is not degraded to an unacceptable level. The size of the LED assembly and the metal later of the LED board may be dictated by the heat generated by the LEDs, the number of LEDs used, the type of lamp, its use environment or the like.

The use of the LED assembly 129 and the metal later of the LED board as the heat dissipating structure eliminates the need to provide a separate component as the heat sink making the lamp of the invention simpler and less expensive to manufacture. For example, some heat sinks are complex shapes that require intricate and expensive tooling that are custom cast or machined aluminum. Moreover, in a typical LED lamp the board or substrate on which the LEDs are mounted must also be connected to the heat sink using screws or other connectors, thermal interface material (such as thermal grease), thermal epoxy or the like. In the lamp of the invention the complex and expensive heat sinks found on typical LED lamps are eliminated. While specific bulb standards are discussed herein the lamp of the invention may assume other standard and or non-standard form factors. While in the previous embodiments the LEDs are mounted on an interior surface of the LED assembly and are inwardly facing, in some embodiments, some of the LEDs may be outwardly facing.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A LED lamp comprising:

an enclosure having an exterior surface that is exposed to the ambient environment, the enclosure being at least partially optically transmissive;

a base connected to the enclosure;

an LED assembly comprising a plurality of LEDs for emitting light when energized though an electrical path from the base and an LED board where the plurality of LEDs are mounted on a mounting surface of the LED board, the LED assembly and the plurality of LEDs being mounted outside of the enclosure for transmitting light through the enclosure into the interior of the enclosure, the LED board having a second surface that is exposed to the ambient environment for transmitting heat from the plurality of LEDs and dissipating heat to the ambient environment where the mounting surface and the second surface are surfaces of the same physical component, wherein the plurality of LEDs are disposed in an optically transmissive channel formed in the enclosure, the channel defining a recess that substantially surrounds the light emitting portion of the plurality of LEDs such that the second surface is formed to conform to the curvature of and be coextensive with the exterior surface of the enclosure.

2. The lamp of claim 1 wherein the base comprises an Edison base.

3. The lamp of claim 1 wherein the plurality of LEDs are disposed about the periphery of the enclosure.

4. The lamp of claim 1 wherein the LED board comprises a thermally conductive material.

5. The lamp of claim 1 wherein the electrical path comprises an electrical conductor formed on the LED board.

6. The lamp of claim 1 wherein the LED board comprises one of a MCPCB, flex circuit and a lead frame.

7. The lamp of claim 1 wherein the outer dimensions of the lamp fall within the ANSI standards for an A19 bulb.

8. The lamp of claim 1 wherein the LED assembly is formed into a three-dimensional shape that comprises portions that are shaped to conform to the shape of the enclosure.

9. The lamp of claim 8 wherein the LED board is bent to form the three-dimensional shape.

10. The lamp of claim 1 further comprising a plurality of LED boards where each of the plurality of LED boards supports at least one LED.

11. The lamp of claim 10 wherein the plurality of LED boards are connected to one another by a support.

12. The lamp of claim 1 wherein the channel is disposed in front of and to the sides of the plurality of LEDs.

13. The lamp of claim 1 wherein the LED assembly is dimensioned to enclose the channel such that light is reflected by the LED assembly into the enclosure.

14. The lamp of claim 1 wherein the LED assembly is ring shaped.

15. The lamp of claim 1 wherein the LED assembly is located at the approximate center of the enclosure.

16. The lamp of claim 1 wherein the plurality of LEDs face at various angles relative to the longitudinal axis of the lamp.

17. The lamp of claim 1 wherein the lamp is a directional lamp comprising a reflective surface mounted in the enclosure and a lens defining an exit surface of the lamp, the LED board being mounted adjacent the reflective surface.

18. The lamp of claim 1 wherein the base contains at least a portion of the lamp electronics.

19. The lamp of claim 1 wherein an electrical conductor in the electrical path extends between the LED assembly and the base.

20. The lamp of claim 19 wherein the electrical conductor extends outside of the enclosure between the LED assembly and the base.

21. The lamp of claim 20 wherein the electrical conductor extends in a channel formed in the outside of the enclosure.

22. The lamp of claim 19 wherein the electrical conductor extends inside of the enclosure between the LED assembly and the base.

23. The lamp of claim 22 wherein the electrical conductor extends through a hole in the enclosure.

24. The lamp of claim 19 wherein the electrical conductor comprises a part of the LED assembly.

25. A LED lamp comprising:

an enclosure having an exterior surface that is exposed to the ambient environment, the enclosure being at least partially optically transmissive;

a base connected to the enclosure;

an LED assembly comprising a plurality of LEDs for emitting light when energized though an electrical path from the base and flexible circuit board where the plurality of LEDs are mounted on a mounting surface of the flexible circuit board, the LED assembly and the plurality of LEDs being mounted outside of the enclosure for transmitting light through the enclosure into the interior of the enclosure, the flexible circuit board having a second surface that is exposed to the ambient environment for transmitting heat from the plurality of LEDs and dissipating heat to the ambient environment where the mounting surface and the second surface are surfaces of the same physical component, wherein the plurality of LEDs are disposed in an optically transmissive channel formed in the enclosure, the channel defining a recess that substantially surrounds the light emitting portion of the plurality of LEDs such that the second surface is formed to conform to the curvature of and be coextensive with the exterior surface of the enclosure.

* * * * *